US006422982B1

(12) United States Patent
Retel

(10) Patent No.: US 6,422,982 B1
(45) Date of Patent: Jul. 23, 2002

(54) CHIROPRACTIC EXERCISER

(76) Inventor: Anthony F. Retel, 716 N. 2nd St. East, Riverton, WY (US) 82501

( * ) Notice: Subject to any disclaimer, the term of this patent is extended or adjusted under 35 U.S.C. 154(b) by 0 days.

(21) Appl. No.: 09/578,477

(22) Filed: May 26, 2000

Related U.S. Application Data

(60) Provisional application No. 60/136,234, filed on May 26, 1999.

(51) Int. Cl.[7] ..... A63B 26/00

(52) U.S. Cl. ..... 482/144; 482/143; 482/148; 602/32

(58) Field of Search ..... 482/142, 143, 482/144, 77, 907, 148; 602/32

(56) References Cited

U.S. PATENT DOCUMENTS 1,757,825 A * 5/1930 Albach ..... 482/38
D137,646 S * 4/1944 Stamm ..... D34/5
4,502,682 A * 3/1985 Miller ..... 272/144
4,566,693 A * 1/1986 Seidentop et al. ..... 272/144
4,717,148 A * 1/1988 Brewer ..... 272/145
4,838,250 A * 6/1989 Angelo ..... 128/75
5,180,161 A * 1/1993 Jordan ..... 482/143
5,407,404 A * 4/1995 Killiam et al. ..... 482/38
5,551,937 A * 9/1996 Kwo ..... 482/144

* cited by examiner

*Primary Examiner*—Michael A. Brown
*Assistant Examiner*—Lori Baker Amerson
(74) *Attorney, Agent, or Firm*—Richard C. Litman

(57) ABSTRACT

A chiropractic exerciser device designed to permit a person to hang upside-down from the waist or hips. The chiropractic exerciser consists of three main parts or elements that include handles, a main body including a hang bar, and an upright hang-bar. The first element are handles connected to a step-up bar and inner legs which facilitate additional stretching and exercising positions. The step-up bar feature allows individuals of any height to use the device. The second element is the main body or base, which includes the hang bar that permits a person to hang upside down. The third element is the upright hang-bar which is designed for pull-ups and hanging thereby allowing the vertebrae to straighten and re-align. The upright hang-bar can be used as a static upright hang-bar permitting standard chin-ups, or it can be used with a spring mechanism.

15 Claims, 6 Drawing Sheets

CHIROPRACTIC EXERCISER

CROSS-REFERENCE TO RELATED APPLICATION

This application claims the benefit of U.S. Provisional Patent Application Ser. No. 60/136,234, filed May 26, 1999.

BACKGROUND OF THE INVENTION

1. Field of the Invention

The present invention relates to a dual chiropractic and exercising device.

2. Description of Related Art

The prior art teaches numerous devices for suspending a person upside down in order to stretch the spinal column and back muscles. The vast majority of prior art devices, however, suspend the person upside-down by their feet or ankles which may place undue burden on their lower legs, knees and ankles. Also, these devices do not position the spinal column in the most beneficial position. When a person hangs from their feet, ankles or lower legs, the back tends to arch backwards; optimum chiropractic effect is achieved, however, when the back is arched forward as provided for in the present invention.

The devices taught in the prior art also tend to be overly bulky and take up a great deal of space. Combining suspension or hanging devices with other exercise functions is rare, except with children's jungle gym equipment and the like. The present invention is both space saving and versatile.

U.S. Pat. No. 4,546,972 issued to Goyer on Oct. 15, 1985, shows a two-position support structure for enabling a tiltable body exerciser to be tilted about a first or a second horizontally extending pivot axis. The support structure includes an A-frame stand and a tiltable exercise structure that operate to suspend a person by their ankles and feet upside-down. The tiltable body exerciser of Goyer suspends a user by their lower legs which places excessive stress on the knees of the users. The exercise apparatus of the current invention does not place any undue force on the lower legs of the user.

U.S. Pat. No. 4,502,682 issued to Miller on Mar. 5, 1985, discloses a full body weight traction device for rotating a human into inverted posture. The apparatus of Miller has a tilt bed which supports the body until tilted, whereupon the body is fully suspended from ankles and feet upside-down, thus placing strain on the knees of the users.

U.S. Pat. No. 4,717,148 issued to Brewer on Jan. 5, 1988, describes a therapeutic exercise apparatus having a frame and a bed device which is pivotally mounted with respect to the frame. The bed is pivotable between an upwardly inclined position for enabling a person to get on and off the bed device, and a downwardly inclined position for enabling a person to hang with their head lower than their feet. The therapeutic exercise apparatus also has a saddle and a rowing device which is mounted on the bed, and which is pivotable backwards and forwards by a person seated on the saddle to simulate a rowing action. While the apparatus shown in Brewer allows for a backwards leaning of the body with the feet above the head, it does not dangle the body above the ground and does not permit the upper body to hang freely. Unlike the present invention, the device shown in Brewer supports the upper body on a bed like structure in a reclined position at all times.

U.S. Pat. No. 5,551,937 issued to Kwo on Sep. 3, 1996, discloses an exercise device having a frame, a back rest set and al leg pressing rod. The apparatus shown in Kwo pivots to allow the human body to fully hang upside-down from the ankles. Unlike the present invention, the device shown by Kwo provides for the entire weight of the body to be born by the lower leg, thereby placing the entire burden on the knees.

FIGS. 1 through 20 in Japanese Patent No. 6-182000, issued in June of 1994, depict an apparatus designed to suspend a human upside down from his feet. This apparatus contains a bed-like structure and pulley apparatus which lifts the prone human into an upside-down position. This apparatus seems to place the entire strain of the body weight on the feet and ankles. This apparatus is apparently not designed for exercising and the like, but for relaxation.

U.S. Pat. No. 4,949,956 issued to Pobran on Aug. 21, 1990, describes a pull-up exercise apparatus comprising a transverse bar, wherein the transverse bar has 45° elbows at each end and a chain extending through the transverse bar. The chain is attached to the ceiling by hooks so that the bar hangs from the ceiling. The device has three sets of hand grips for grasping the device to perform pull-ups. A human could potentially hang upside down by the inside of their knees from the bar. However, this acrobatic movement would require a lot of effort and athletic maneuverability on part of the human body.

None of the above inventions and patents, taken either singly or in combination, is seen to describe the instant invention as claimed.

SUMMARY OF THE INVENTION

The present invention is directed towards a combined chiropractic and exercising device which is designed to permit a person to hang, stretching the skeletal system in the neck, back and hips, in a variety of ways. The term "person (s)" as used herein, includes, but is not limited to, children, adults, senior citizens or individuals who have not had surgeries or other medical complications. Individuals having a history of medical problems should preferably consult with a physician prior to using the chiropractic and exercising device. The chiropractic exerciser has the additional function of an upright hang-bar that has multiple manifestations. The upright hang-bar can be used as a static pull-up bar permitting standard chin-ups and other hanging exercises, or it can be used with a spring mechanism. The device is intended to improve and eliminate a variety of physical conditions involving the skeletal, nerve and muscle area of the neck and hips by permitting a person to exercise and stretch while hanging upside down.

There are three main parts or elements to the chiropractic exerciser: handles, a main body including a hang bar, and an upright hang-bar. The first element are the handles, connected to a step-up bar and inner legs, that facilitate additional stretching and exercising positions. The step-up bar feature allows individuals of any height to use the device. The second element is the main body or base, which includes the hang bar that permits a person to hang upside down. The third element is the upright hang-bar which is designed for pull-ups and hanging thereby allowing the vertebrae to straighten and re-align. The upright hang-bar consists of both hard (without a spring) and soft (with a spring) attachments.

Accordingly, it is a principal object of the invention to provide a convenient apparatus to permit a person to comfortably hang upside-down from the waist in a relaxing manner.

It is another object of the invention to facilitate the realignment of the spine of a person by counteracting the effect of gravity by permitting a person to hang upside-down.

It is a further object of the invention to provide a convenient upright hang-bar for exercise.

Still another object of the invention is to provide an easily assembled and portable chiropractic exerciser which can be utilized at home, in fitness centers, gymnasiums, senior citizen centers, schools, colleges or offices and the like.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
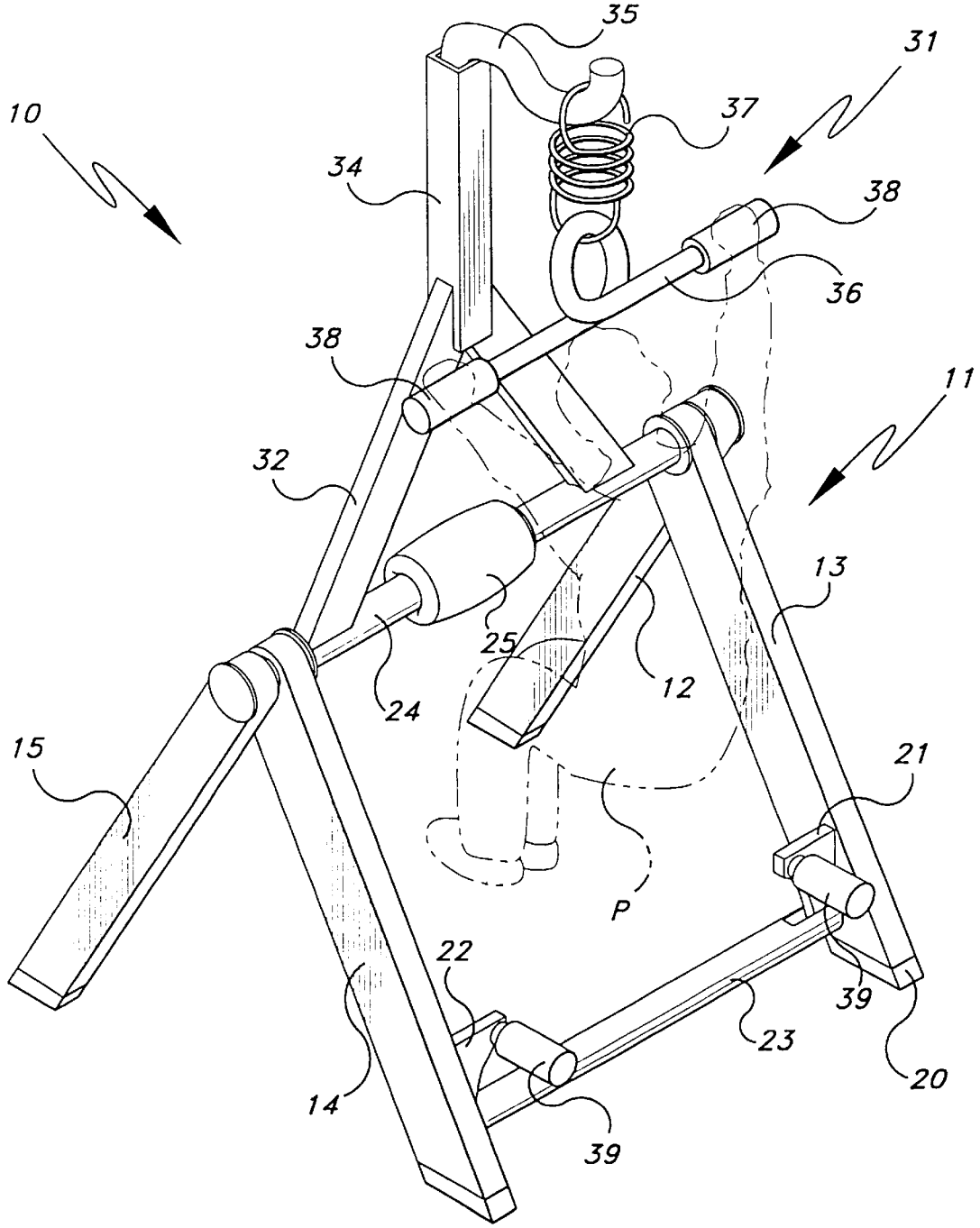
FIG. 1 is an environmental view of a chiropractic exerciser according to the present invention, and a person shown in phantom.
Figure 6:
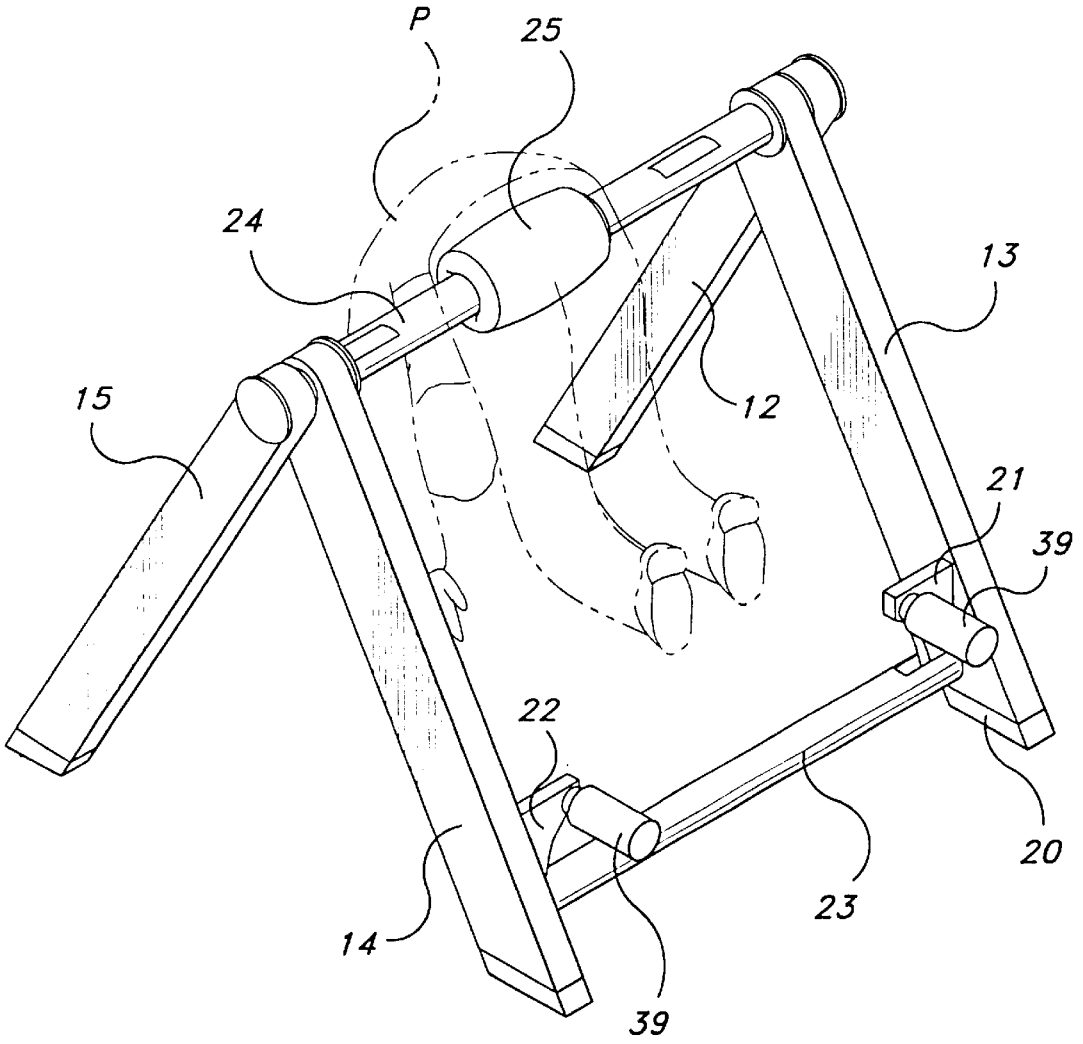
FIG. 6 is an environmental view of a person shown in phantom hanging over the main body and hang bar of the chiropractic exerciser according to the present invention.

As shown in FIG. 1, the present invention comprises a stand alone chiropractic exerciser device generally referred to in the Figure as 10. FIG. 1 also depicts a person P, shown in phantom lines, grasping the upright hang-bar 36 in order to perform a pull-up. The base unit, also referred to herein as the main body, generally referred to as 11, is the primary aspect of the invention, and the upright, generally referred to as 31, is an additional removable element. The base unit 11 is used for many of the hanging exercises provided for by the exerciser, such as shown in FIG. 6 where a person P, shown in phantom lines, is hanging over a hanging bar 24 bent at the waist or pelvis with his weight being supported by the hips and upper thighs. The upright 31 is added to the main body 11 to provide the support for the upright hang-bar 36, which expands the chiropractic and exercise capabilities of the device 10. The total height of the invention fully assembled is preferably eighty-four inches. (It will be understood that the recitation of dimensions in this specification is for illustrative purposes only; actual dimensions may vary.)

Figure 2:
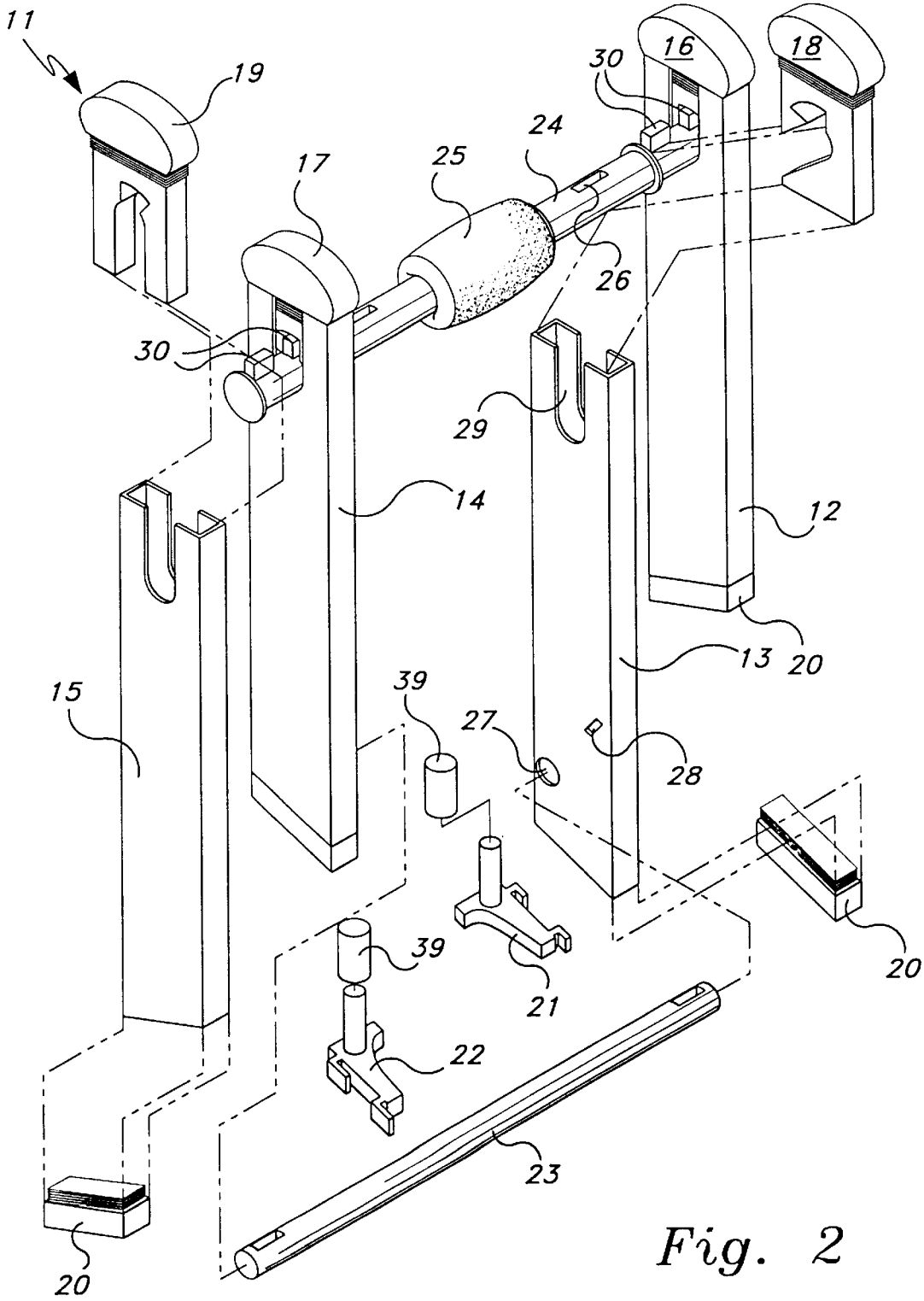
FIG. 2 is an exploded view of the base of the chiropractic exerciser according to the present invention.

The construction of the base unit 11, as depicted in the exploded view of FIG. 2, is sturdy and allows for various hanging exercises. The base unit 11 is preferably made mainly of steel, aluminum, or metal strength plastic tubing. The base unit 11 includes a front right leg 14 that is a mirror image of the front left leg 13. The base unit 11 also contains a rear left leg 12 and a rear right leg 15. Each leg has a top portion and a bottom portion, and each leg is preferably constructed of 44"×2"×1" steel, aluminum or metal strength plastic tubing. The bottom portion of the front right leg 14 is connected to the bottom portion of the front right leg 13 by a step-up bar 23, which fits through holes or apertures 27 in the bottom portion of each of the two front legs.

A right handle 22 and a left handle 21, also mirror images of one another, each include a short cylindrical rod integral with a flat, tapered or arched strut having a pair of hooks on a side edge. The bottom portion of the handle struts extends through slits defined in the step-up bar, and the hooks and the ends of the step-up bar are inserted into the slots 28 and holes 27 located on the bottom portion of the two front legs. Optionally, handle grips 39 fit over the handles as shown in FIG. 2. Hence the handles 21 and 22 help to retain the step-up bar 23 between the front legs 13 and 14. The handles 21 and 22 extend the functionality of the chiropractic exerciser 10, permitting exercises to be performed by gripping the handles in a sitting or legs stretched out position with the back to the base unit 11, using arm strength to support the trunk of the body and stretching the back and hip areas. The step-up bar 23 is preferably made of a 25¾" long×1½" diameter steel, aluminum, or metal strength plastic tube pipe. Ribbed leg pads 20 are inserted in the bottommost region of each of the four legs (12–15) to prevent the chiropractic exerciser 10 from slipping and sliding while in use. The ribbed leg pads 20 also protect the floor that the chiropractic exerciser 10 is sitting on, preventing the floor from becoming scuffed up and the like.

The top portion of each of the four legs has a generally U-shaped cutout 29. The hang-bar 24 is a cylindrical rod which is preferably made of a 25¾" long×1½" diameter steel, aluminum, or metal strength plastic tube pipe. The hang-bar 24 includes four cams or keys 30 which project radially from the bar 24 and are aligned linearly, two cams 30 being disposed at each of the opposing ends of the hang-bar 24. The hang-bar 24 is placed in the U-shaped cutouts 29 of each leg as shown in FIG. 2. The hang-bar 24 may include an annular flange at each end of the bar 24 to preclude the legs 12–15 from sliding along the bar 24.

The hang-bar 24 is retained in the U-shaped slots 29 by a plurality of inserts 16–19. Into the U-shaped cutout 29 of the rear left leg 12 is placed the rear left insert 16, as shown. Likewise, into the U-shaped cutout 29 of the rear right leg 15 is placed the rear right insert 19. The rear left insert 16 and the rear right insert 19 are mirror images of one another. Each of the inserts 16 and 19 has a slot defined therein dimensioned to slide the insert 16 or 19 over the hang-bar 24, and a radial cutout or keyway at the end of the slot for receiving the cam 30 and permitting the cam 30, and therefore the leg 12 or 15, to rotate through an arc defined by the radial cutout. Into the U-shaped cutout 29 of the front left leg 13 is placed the front left insert 18, as shown. Likewise, into the U-shaped cutout 29 of the front right leg 14 is placed the front right insert 17. The front left insert 18 and the front right insert 17 are mirror images of one another. Each of the inserts 18 and 17 has a slot defined therein dimensioned to slide the insert 18 or 17 over the hang-bar 24, and a radial cutout or keyway at the end of the slot for receiving the cam 30 and permitting the cam 30, and therefore the leg 13 or 14, to rotate through an arc defined by the radial cutout. The radial cutout defined in the inserts 16 and 19 are oriented in a direction opposite to the orientation of the radial cutouts defined in the inserts 17 and 18, so that the front legs 13 and 14 may be rotated about the hang-bar 24 in a direction opposite to the rotation of the rear legs 12 and 15 about the hang-bar 24 in order to spread the legs of the base 11.

The inserts (16–19) fit over the hang-bar 24 as shown in FIG. 2, and hold it in place. The inserts (16–19) also hold the legs in their position relative to one another, as demonstrated in FIG. 2. The inserts (16–19) allow each leg to open or close to an exact position because of the cams 30 located on the hang-bar 24. Each insert (16–19) preferably has the general dimension of 7"×1¾"×¾". Preferably, the total height of the base unit 11 is forty inches, and the width of the work area is twenty-four inches.

Figure 3:
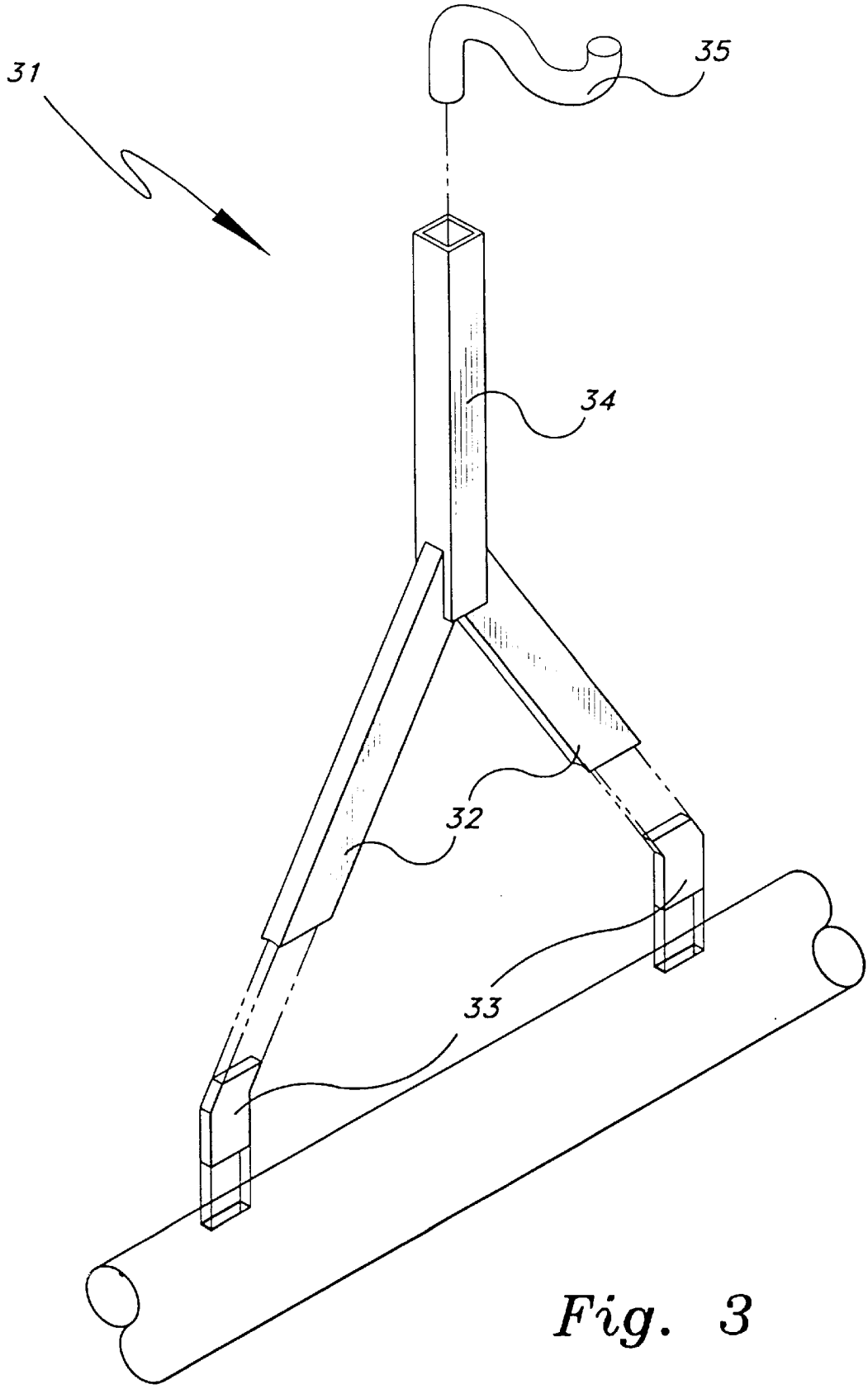
FIG. 3 is an exploded view of a removable upright addition to the base of the chiropractic exerciser according to the present invention.

The hang-bar 24 ideally has a comfort pad 25, which is preferably a hollow cylindrical padded material that the hang-bar 24 can fit through as shown in FIGS. 1–2. The comfort pad 25 is preferably eighteen inches by three inches in dimensions. On either side of the comfort pad 25, there are two slits 26 located in the hang-bar 24 designed to receive the steel stabilization plates 33 (shown in FIG. 3) of the upright 31, wherein the upright 31 is removably connected to the hang-bar 24. The steel stabilization plates 33 fit into the bottom portion of the upright legs 32, and are preferably permanently welded into place on the upright legs 32. The steel stabilization plates 33 are preferably made of 3"×1¾"×¼" steel plate, wherein the 1¾" dimension tapers to about 1", to roughly form a wedge-like shape, as shown in FIG. 3.

The top portion of the upright legs 32 are welded to the bottom portion of the upright base post 34 in a trident pattern with an approximately forty-five degree angle between the two upright legs 32. The upright base 34 is preferably made of steel, aluminum, or metal strength plastic tubing which is 5½×2"×1" in dimensions, and the upright legs 32 are preferably made of 31"×2"×1" steel, aluminum, or metal strength plastic tubing. The upright hook 35 is inserted into the top portion of the upright base 34. The total height of the upright 31, when assembled, is preferably forty-four inches. The upright hook 35 is preferably made of ½" steel rod that has been bent to form a generally S-shaped hook that protrudes a total of four inches outward from the upright base 34.

Figure 4:
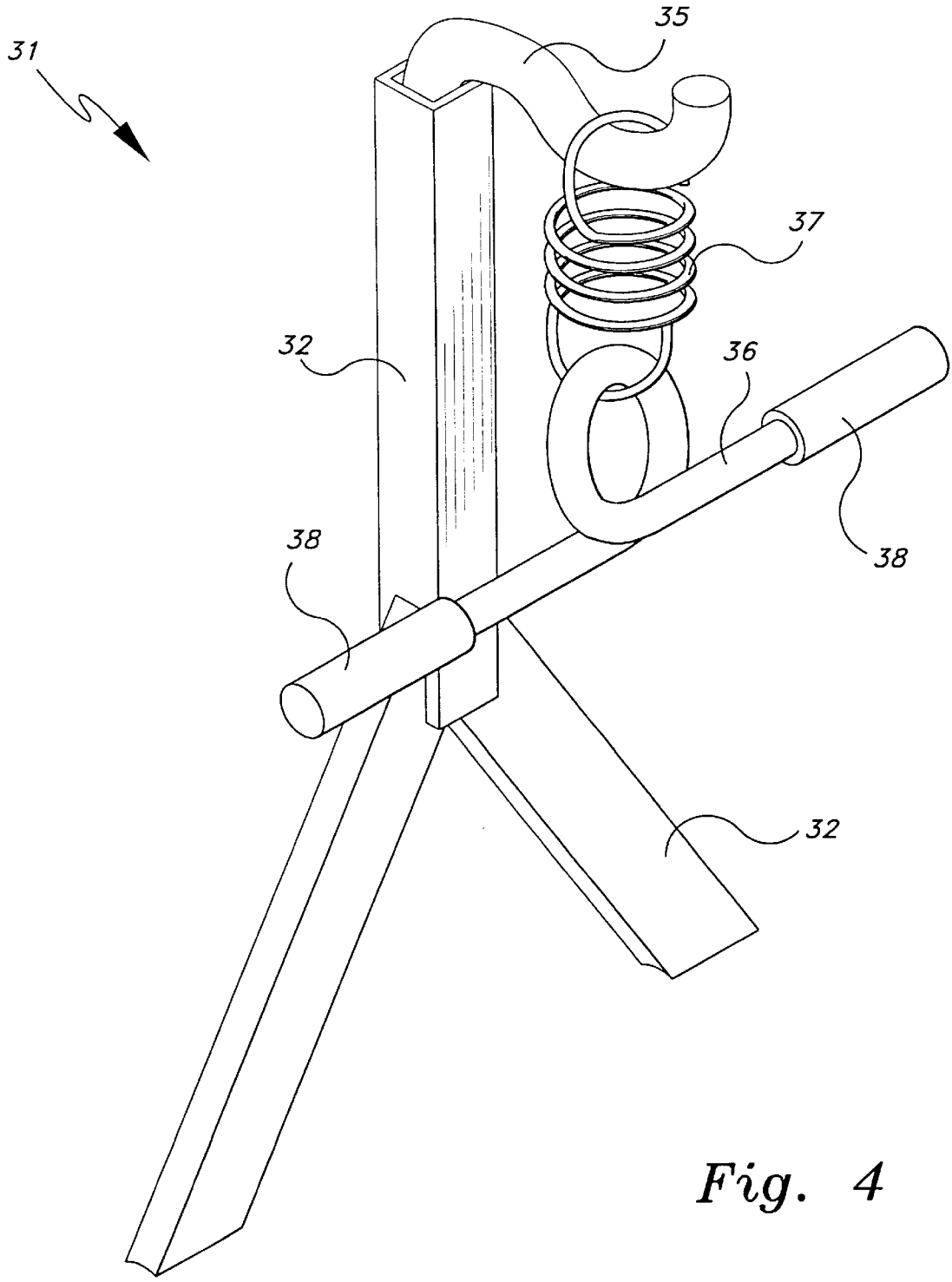
FIG. 4 is a perspective view of the upright addition with a upright hang-bar attached by a spring.
Figure 5:
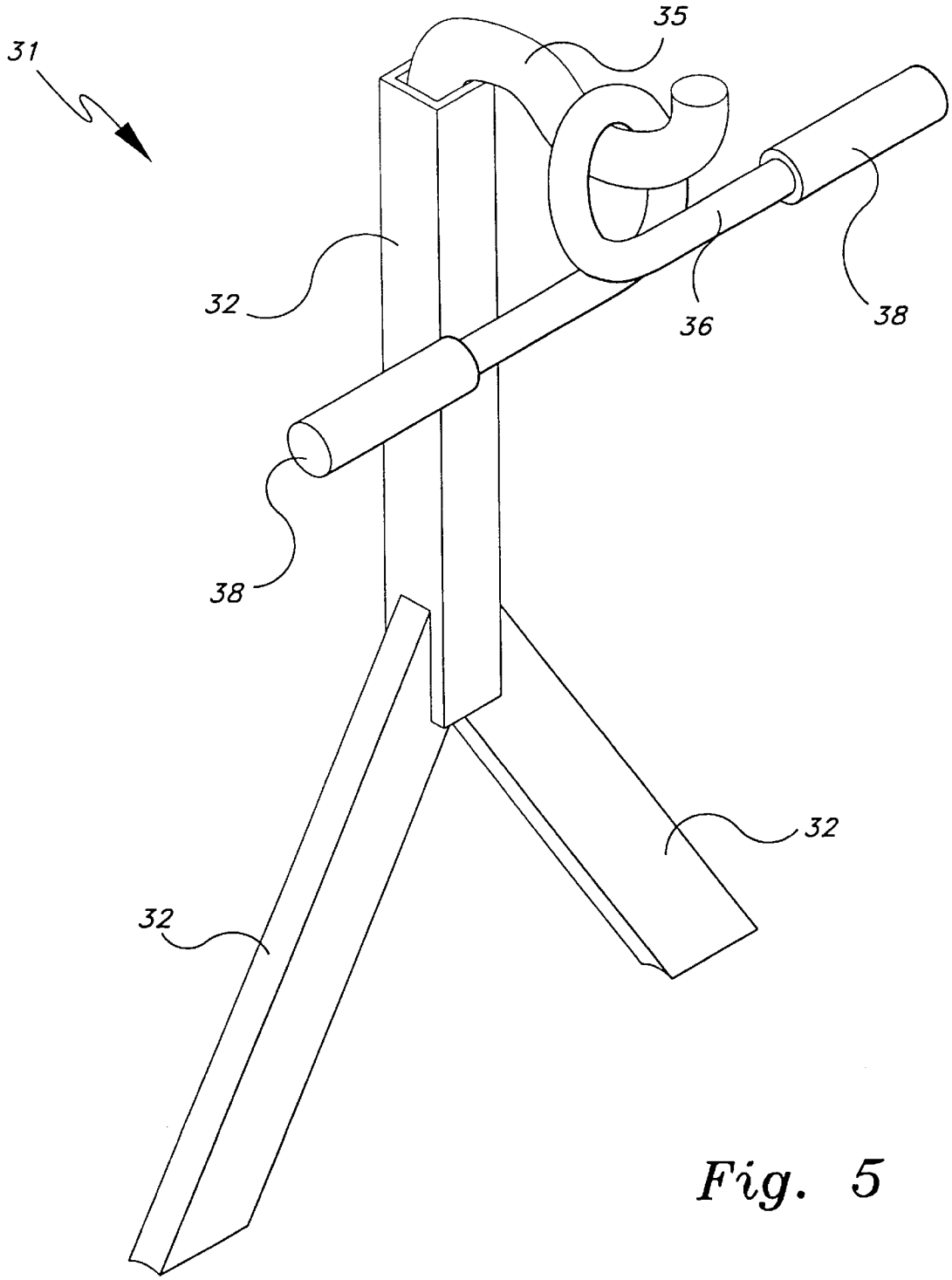
FIG. 5 is a perspective view of the upright addition with the upright hang-bar attached directly to the upright.

The upright hang-bar 36 can be hooked directly to the upright hook 35 as shown in FIG. 5, or it can be hung from a spring 37, wherein the spring 37 hangs from the upright hook 35 as shown in FIG. 4. The upright hang-bar 36 is preferably 13"×¾" and made from steel rod, and has a loop in the middle as shown FIGS. 4–5. optionally, upright hang-bar handle grips 38 may be placed on the ends of the upright hang-bar to protect the hands. The spring 37 is preferably one of several interchangeable heavy duty industrial style springs of various gauges, strengths, and spring constants, the selection of the spring 37 depending upon the weight of the user.

A series of stretching and exercising techniques intended to improve and eliminate a variety of physical conditions involving the skeletal, nerve and muscle areas of the neck, back and hips have been designed for use with the present invention. This invention, when used regularly, improves conditions related to dislocated skeletal structure and vertebrae, pinched nerves, neck pains and other aches and ailments. Stretching and exercising with the apparatus of the present invention also enhances overall physical health and strength in the neck, back, abdomen, legs and arms.

Hanging upside-down is very beneficial for the spine and relaxes the muscles in the back. Exercises that permit the body to hang from the waist provide a stretching of the back muscles and a relaxing of the spinal cord. Unnecessary torque or stress is not placed on the ankles, feet or knees. The back and pelvis are properly aligned in a natural position rather than the pelvis being thrust forward as occurs when hanging from the ankles. By having the body assume an upside-down sitting position, the chiropractic exerciser results in much less pressure from blood rushing to the head. Also, since the person's body is not strapped into the apparatus of the current invention, the user has greater control and can quit when they wish without the aid of anyone else.

Hanging upside-down, in the manner utilized by the present invention, permits the spinal column to realign itself after being compressed by gravity. As a person walks, stands or sits upright the spinal column becomes compressed and misaligned causing the back to ache. This spinal compression also reduces the height of a person gradually as they age. Hanging or stretching, in this manner, reverses the effects of bone displacement and collapse, caused by gravity, and the constant pounding of the skeletal structure from a variety of activity. When a person exercises using the chiropractic exerciser regularly, the normal collapsing of the skeletal structure, especially the vertebrae, caused by gravity and the impact of everyday life is slowed drastically or even reversed.

As people age, they tend to develop the middle age spread and their appearance becomes thick. In time, this leads to a pot belly. These physical changes are frequently due to the collapsing effect of the vertebrae, and padded discs between them, brought on by the constant, downward pressure of body weight from the head down as a result of gravity. The shortening of the human body results in the belly area becoming protruded. Daily exercises, using the present invention, slows and can even reverse the effects of skeletal compression. Hanging upside-down, while performing simple and easy stretches and exercises, allows the bones in the neck, back and hips to relax and return to their natural state. This relaxation in turn helps the body maintain a trim, streamlined appearance.

Hanging upside-down, in this manner, permits nutrients and blood to flow more freely to otherwise restricted areas of the body. This, in turn, reduces and eliminates stiffness in the neck, back and hip areas. Furthermore, yawning and stretching are nature's way of getting needed oxygen and blood circulating. The exercises used with the chiropractic exerciser are much more efficient than yawning and stretching in getting needed oxygen and blood circulating. Thus, when the chiropractic exerciser is used regularly yawning and stretching ceases except in extreme stages of sleepiness.

It is to be understood that the present invention is not limited to the sole embodiments described above, but encompasses any and all embodiments within the scope of the following claims.

I claim:

1. A chiropractic exerciser device, comprising a base unit having:

a) an elongated hang-bar having opposite ends;

b) two front legs having a top portion and a bottom portion, the top portion of each front leg being pivotally attached to said hang-bar, said two front legs being spaced apart and disposed at the opposite ends of said hang-bar;

c) two rear legs having a top portion and a bottom portion, the top portion of each rear leg being pivotally attached to said hang-bar, said two rear legs being spaced apart and disposed at the opposite ends of said hang-bar;

d) a step-up bar attached to and extending between the bottom portion of said two front legs;

e) two handles attached to the bottom portion of said two front legs and said step-up bar;

f) said front legs and said rear legs being hollow and tubular, each said leg having a U-shaped slot defined in the top portion of said leg, the opposite ends of said hang-bar being disposed in the U-shaped slots, the top of each said leg being open;

g) said hang-bar being cylindrical and having two spaced apart cams projecting radially from said hang-bar at each end of said hang-bar, the cams being aligned linearly; and h) wherein the top portion of said front legs and said rear legs each comprise an insert placed in the open top of said leg, the insert having a slot defined in which said hang-bar is received, the slot having a radial cutout for receiving one of said cams, each said leg being rotatable about said hang-bar in an arc defined by said radial cutout in order to spread said front and rear legs apart by a predetermined distance.

2. The chiropractic exerciser according to claim 1, further comprising a pair of hand grips disposed on said two handles.

3. The chiropractic exerciser according to claim 1, further comprising a plurality of ribbed leg pads attached to the bottom portions of said front and rear legs.

4. The chiropractic exerciser according to claim 1, further comprising a hollow comfort pad made of padded material centrally disposed about said hang-bar.

5. The chiropractic exerciser according to claim 1, wherein said hang-bar, said front and rear legs, and said step-up bar are made from steel.

6. The chiropractic exerciser according to claim 1, wherein said hang-bar, said front and rear legs, and said step-up bar are made from aluminum.

7. The chiropractic exerciser according to claim 1, wherein said hang-bar, said front and rear legs, and said step-up bar are made from metal strength plastic.

8. The chiropractic exerciser according to claim 7, further comprising a spring having a first end and a second end, the first end of the spring being attached to said upright hook, and said upright hang-bar being attached to the second end of the spring.

9. The chiropractic exerciser according to claim 7, further comprising a pair of hand grips disposed on said upright hang-bar.

10. The chiropractic exerciser according to claim 7, wherein said upright base post and said upright legs are made from steel.

11. The chiropractic exerciser according to claim 7, wherein said upright base post and said upright legs are made from aluminum.

12. The chiropractic exerciser according to claim 7, wherein said upright base post and said upright legs are made from metal strength plastic.

13. The chiropractic exerciser according to claim 7, wherein said upright base post and said upright legs are hollow and tubular.

14. A chiropractic exerciser device, comprising:

a) a base unit having:

i) an elongated hang-bar having opposite ends;

ii) two front legs having a top portion and a bottom portion, the top portion of each front leg being pivotally attached to said hang-bar, said two front legs being spaced apart and disposed at the opposite ends of said hang-bar;

iii) two rear legs having a top portion and a bottom portion, the top portion of each rear leg being pivotally attached to said hang-bar, said two rear legs being spaced apart and disposed at the opposite ends of said hang-bar;

iv) a step-up bar attached to and extending between the bottom portion of said two front legs; and v) two handles attached to the bottom portion of said two front legs and said step-up bar; and b) an upright including:

i) an upright base post having a top portion and a bottom portion;

ii) two upright legs attached to said bottom portion of said base post, each leg having a bottom portion;

iii) two steel stabilization plates attached to the bottom portion of said upright legs, said stabilization plates being slidably received in the slits defined in said hang-bar;

iv) an upright hook attached to said top portion of said upright base post; and v) an upright hang-bar removably attached to said upright hook.

15. A chiropractic exerciser device, comprising a base unit having:

a) an elongated hang-bar having opposite ends and having a pair of slits defined therein;

b) two front legs having a top portion and a bottom portion, the top portion of each front leg being pivotally attached to said hang-bar, said two front legs being spaced apart and disposed at the opposite ends of said hang-bar;

c) two rear legs having a top portion and a bottom portion, the top portion of each rear leg being pivotally attached to said hang-bar, said two rear legs being spaced apart and disposed at the opposite ends of said hang-bar;

d) a step-up bar attached to and extending between the bottom portion of said two front legs;

e) two handles attached to the bottom portion of said two front legs and said step-up bar;

f) an upright base post having a top portion and a bottom portion;

g) two upright legs attached to the bottom portion of said base post, each leg having a bottom portion;

h) two steel stabilization plates attached to the bottom portion of said upright legs, said stabilization plates being slidably received in the slits defined in said elongated hang-bar;

i) an upright hook attached to said top portion of said upright base post; and j) an upright hang-bar removably attached to said upright hook.

* * * * *